US006694857B2

(12) United States Patent
Eriksson

(10) Patent No.: US 6,694,857 B2
(45) Date of Patent: Feb. 24, 2004

(54) APPARATUS FOR DISCHARGING SHELLS FROM AN AMMUNITION MAGAZINE, AND A SHELL-DISCHARGING ARRANGEMENT COMPRISING TWO SUCH APPARATUSES

(75) Inventor: Claes Eriksson, Arnasvall (SE)

(73) Assignee: Alvis Hagglunds AB, Ornskoldsvik (SE)

( * ) Notice: Subject to any disclaimer, the term of this patent is extended or adjusted under 35 U.S.C. 154(b) by 0 days.

(21) Appl. No.: 10/204,183

(22) PCT Filed: Feb. 15, 2001

(86) PCT No.: PCT/SE01/00325

§ 371 (c)(1),
(2), (4) Date: Aug. 19, 2002

(87) PCT Pub. No.: WO01/61266

PCT Pub. Date: Aug. 23, 2001

(65) Prior Publication Data

US 2003/0010188 A1 Jan. 16, 2003

(30) Foreign Application Priority Data

Feb. 18, 2000 (SE) ..... 0000535

(51) Int. Cl.[7] ..... F41A 9/43

(52) U.S. Cl. ..... 89/47; 89/45; 89/34

(58) Field of Search ..... 89/45, 47, 11, 89/9, 34

(56) References Cited

U.S. PATENT DOCUMENTS

| | | | | | |
|---|---|---|---|---|---|
| 1,602,568 | A | * | 10/1926 | Conlon | |
| 3,102,452 | A | * | 9/1963 | Gross | 89/47 |
| 5,196,643 | A | * | 3/1993 | Jorg et al. | 89/47 |
| 5,756,923 | A | * | 5/1998 | Golden et al. | 89/47 |

FOREIGN PATENT DOCUMENTS

| | | | |
|---|---|---|---|
| CH | 348895 | | 10/1960 |
| DE | 3042675 | | 6/1982 |
| DE | 34 13 516 | A1 * | 10/1985 |
| EP | 064 661 | A2 * | 11/1982 |
| FR | 688.257 | | 8/1930 |
| SE | 217 868 | | 12/1968 |

* cited by examiner

*Primary Examiner*—Stephen M. Johnson
(74) *Attorney, Agent, or Firm*—Young & Thompson

(57) ABSTRACT

An apparatus (20) for discharging shells from a magazine. The apparatus comprises a first ramming element (42) for initial, primary linear discharge of a shell (G) from the magazine, and a second ramming element (56) for continued, secondary feed of the shell (G) to an advanced position while the return movement of the first ramming element (42) is effected.

19 Claims, 7 Drawing Sheets

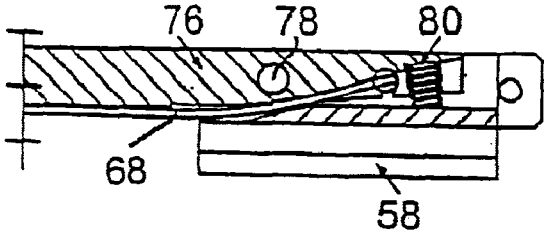
Fig.9
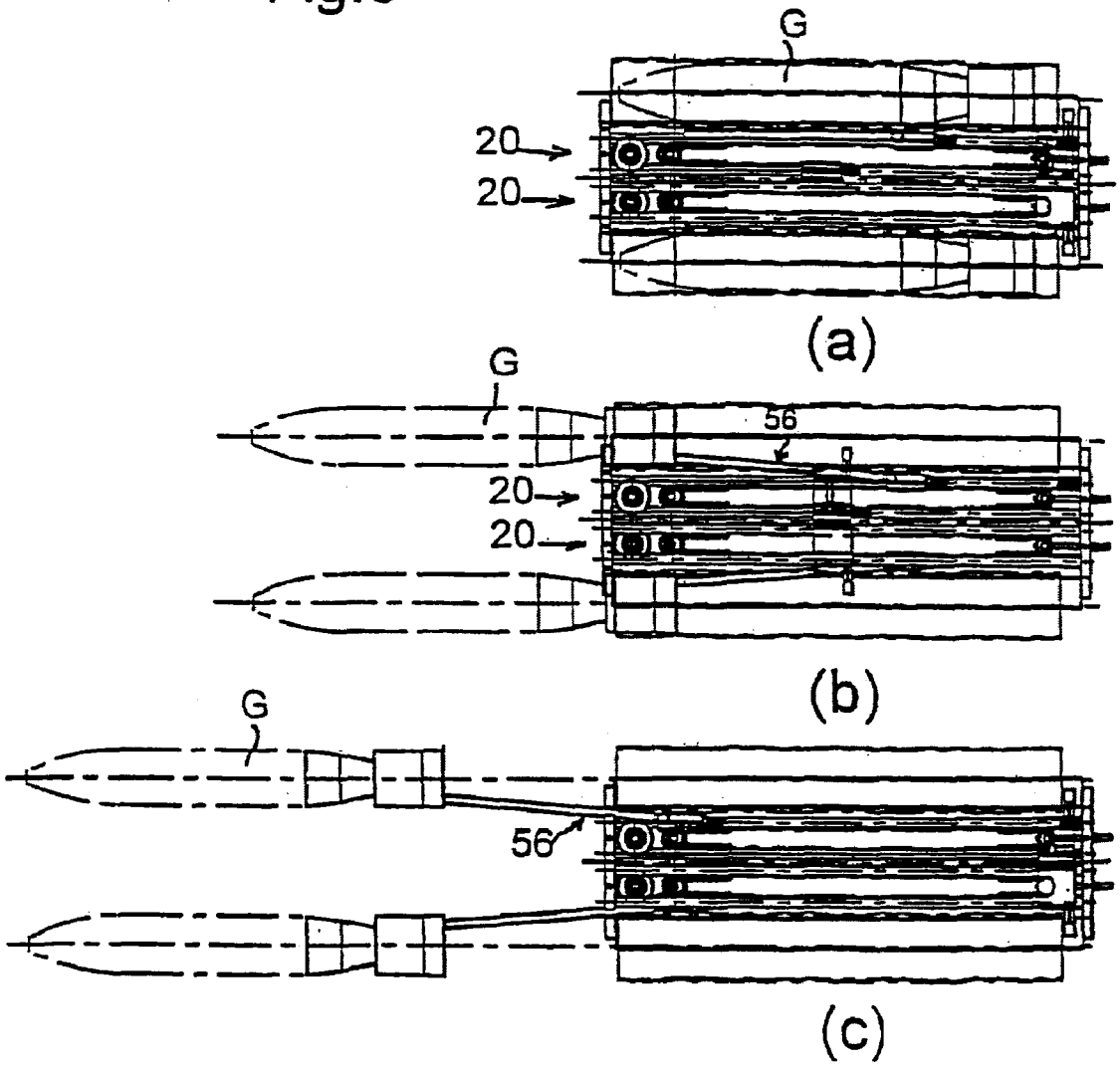
Fig.8a-c

APPARATUS FOR DISCHARGING SHELLS FROM AN AMMUNITION MAGAZINE, AND A SHELL-DISCHARGING ARRANGEMENT COMPRISING TWO SUCH APPARATUSES

CROSS REFERENCE TO RELATED APPLICATION

This application is the 35 USC 371 national stage of international application PCT/SE01/00325 filed on Feb. 15, 2001, which designated the United States of America.

FIELD OF THE INVENTION

The present invention relates to an apparatus for discharging shells from an ammunition magazine, comprising a frame and a drive arrangement supported by the frame for individual linear displacement of shells from a first, ejection position in the magazine to a second, advanced position.

BACKGROUND OF THE INVENTION

In connection with loading a shell-throwing weapon from the rear end of the barrel of the weapon in mobile units in which the space is limited, a clear requirement exists for compact design of both ammunition magazines and discharging and loading mechanisms for the shells. The discharging apparatus, which ejects the shells individually from the magazine, must be capable of displacing the shells linearly into an advanced position, which is either a position on a loading tray directly behind the barrel of the weapon or an inserted loading position directly inside the latter.

SUMMARY OF THE INVENTION

In order to make possible a sufficiently long displacement movement of the shells by means of a discharging apparatus of relatively short overall length, which corresponds essentially to the length of the shells to be discharged, it is proposed according to the present invention that the drive arrangement comprises an endless, first drive element with two elongate, parallel strands, a first ramming element which is connected to the drive element and arranged so as to come into engagement with a rear portion of a shell present in the ejection position and advance the shell to a position between said first and second positions during the movement of the ramming element together with the drive element along one strand of the latter, and a second ramming element arranged so as to come into engagement with the rear portion of the shell present in the intermediate position and advance the shell further to the second, advanced position during the return movement of the first ramming element together with the drive element along the other strand of the latter. By virtue of such a construction of the discharging apparatus, the return movement of the first ramming element is therefore used to produce a further advance movement of each shell by means of a second ramming element, as a result of which it is possible to obtain a long feed distance for the shell in two steps in relation to the length of the discharging apparatus itself.

According to a preferred shell-discharging arrangement according to the invention, two discharging apparatuses of the type described above are arranged side by side in a mirror-inverted manner in relation to one another on a common frame, the arrangement being positioned between two adjacent, parallel magazines for shells.

Further features of the apparatus according to the invention are indicated in the dependent patent claims below.

BRIEF DESCRIPTION OF THE DRAWINGS

The invention will now be described in greater detail below with reference to the appended drawings, in which:

FIGS. 8*a–c* show in plan view firstly, a first initial ejection position of two shells in respective magazines, secondly an intermediate position of the shells after the first ramming element has performed its working stroke and the second ramming element is ready to come into play, and thirdly a position of maximum advance achieved by means of the second ramming element, and FIG. 9 is a partly sectioned plan view of the second ramming element.

DETAILED DESCRIPTION OF THE INVENTION

Figure 1:
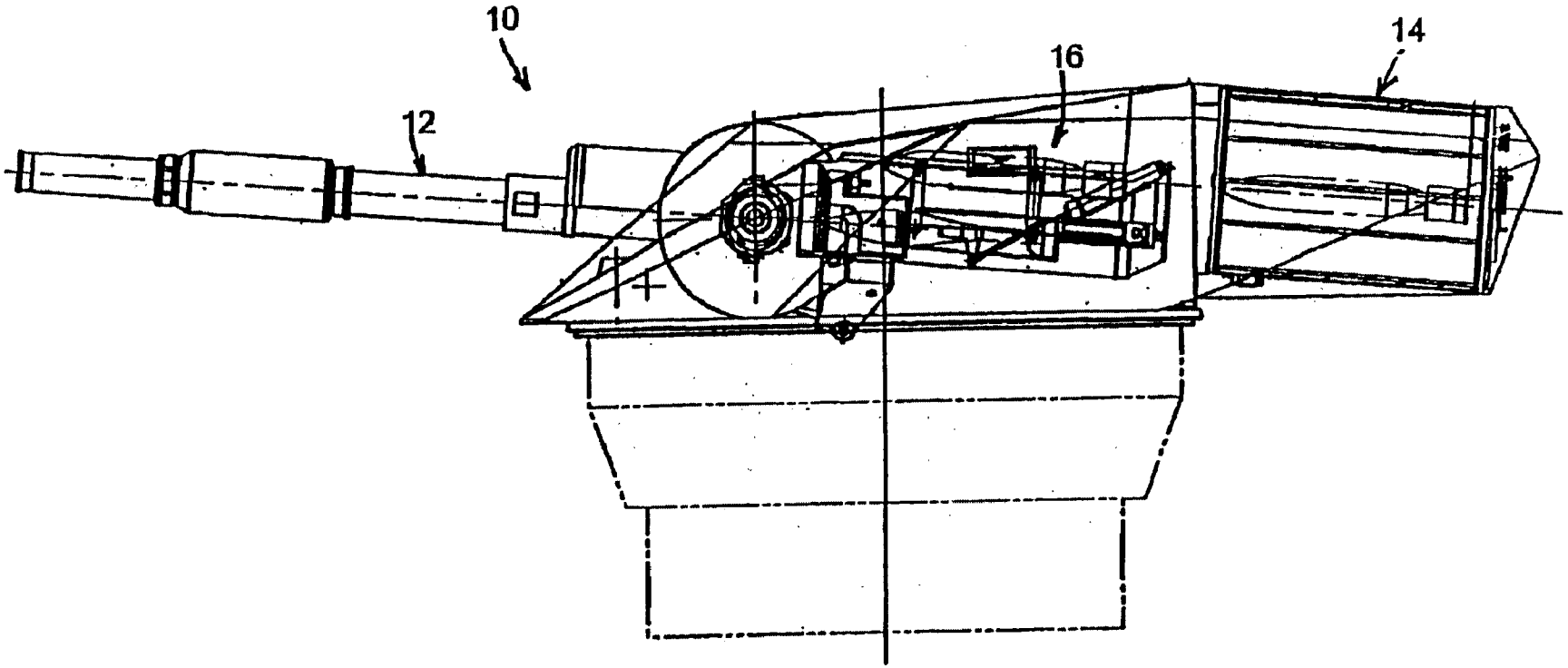
FIG. 1 is a side view of a shell-throwing weapon with an associated magazine unit and loading mechanism for loading the weapon from the rear end of its barrel.
Figure 2:
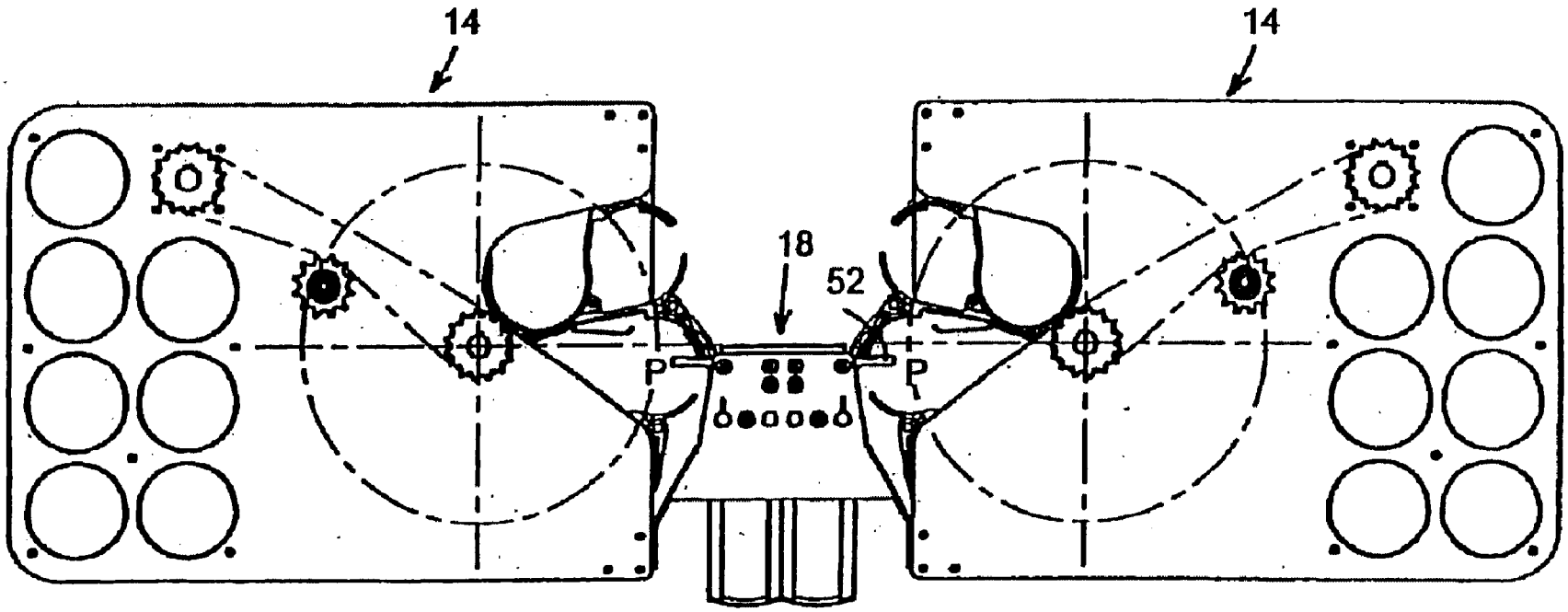
FIG. 2 is an end view from the rear of two shell magazines of the revolving type arranged in a mirror-inverted manner with, positioned between the magazines, a discharging apparatus according to the present invention for ejecting and feeding a shell from either magazine towards a loading position.

FIG. 1 shows a shell-throwing weapon 10 with two pivotable, raisable and lowerable barrels 12 lying next to one another, a rear ammunition store in the form of a twin revolving magazine 14 for shells, and an intermediate loading mechanism 16 for individual rear-loading of shells into the respective barrels 12. As shown in greater detail in FIG. 2, a shell-discharging arrangement 18 according to the invention for linear ejection and feed of a shell from the respective magazine 14 to a position in the loading mechanism 16 directly behind the barrels 12 is arranged between the two shell magazines 14 arranged next to one another in a mirror-inverted manner.

As shown in FIGS. 3, 4 and 6–8, the shell-discharging arrangement 18 comprises two discharging apparatuses 20, lying next to one another in a mirror-inverted manner and mounted on a common frame 22, for individual linear displacement of a shell in two steps from the respective magazine 14 forwards to the loading mechanism 16 in the manner described below. The common frame 22 has an elongate rectangular base plate 24, an end-wall piece 26 at each short end of the base plate 24, and a pair of sidepieces 28 which can have attachments for mounting the discharging arrangement 18 on the inwardly facing sides of the magazines 14.

As the discharging apparatuses 20 are of identical construction, only one of them is described. Each apparatus

20 comprises a first, endless drive element in the form of a chain 30 with an upper and a lower layer 30*a*, 30*b* which are driven in one and the same direction by a motor-driven gear drive 32 at one end and are deflected by a turning wheel 33 at the other end. The drive element 30 therefore forms an oblong loop with an outer strand 34 and an inner strand 36. Mounted pivotably on the top side of the upper chain layer 30*a* is a driver element 38 which engages displaceably in a transverse groove 40 (FIG. 5) on the underside of a first ramming element 42 for an initial linear ejection and displacement movement of a shell from the associated magazine 14. The ramming element 42 has a pair of parallel guide grooves 44 and 46 for longitudinal and linear guidance of the ramming element 42 on a pair of guides 48 and, respectively, 50 fastened in the end-wall pieces 26. A finger 52 projects to the side from the ramming element 42 for engagement with a rear portion of a shell G (FIG. 8*a*) which is located in an ejection position P (FIGS. 2, 8*a*) in the magazine 14. The finger 52 can be designed with a bevel 54 in order to free a locking element (not shown) for axially securing the shells in the respective magazines before ejection of the shell is started.

The discharging apparatus 20 also comprises a second ramming element 56 for a secondary linear displacement movement of the shell G from an intermediate position according to FIG. 8*b*, into which the shell G has been displaced by the first ramming element 42, to a final, advanced position according to FIG. 8*c*, in which the shell G is supported by the loading mechanism 16 directly behind and at a level above the barrel 12 (FIG. 1). The second ramming element 56 has an outer slide 58 which is displaceable on a guide 60 located below and parallel to the guide 48 and is guided at the top in a groove 62 in the latter. The slide 58 is displaceable in the feed direction of the shell by means of an inner slide 64 which is linearly displaceable on a guide 66 located below and parallel to the guide 50 and is kinematically connected to the outer slide 58 via a flexible, force-transmitting element in the form of a line 68 which is elastically fastened in the inner slide 64 and extends forwards and around a line guide wheel 70 and then backwards to the outer slide 58. Like the outer slide 58, the inner slide 64 is guided at the top in a groove 72 in the guide 50 lying above. A tension spring 74 is threaded onto the guide 60, and its front end is fastened at the rear on the slide 58 while its rear end is fastened in the rear end-wall piece 26 of the frame 22, the spring 74 being arranged so as to bring about a return movement of the second ramming element 56 after the displacement movement forwards of the same has been completed.

Figure 3:
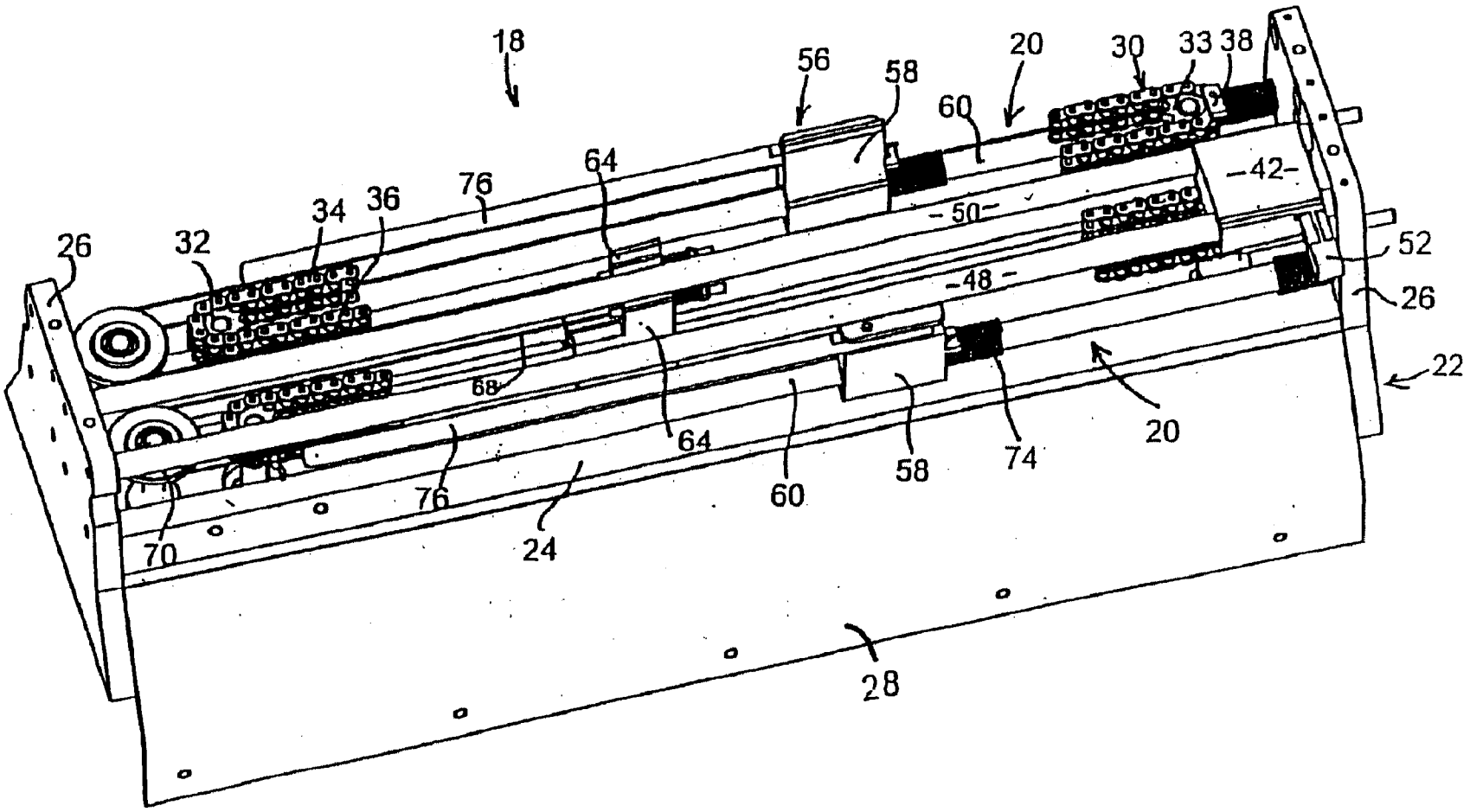
FIG. 3 is a perspective view of the discharging apparatus according to the invention with certain parts omitted for the sake of clarity.
Figure 4:
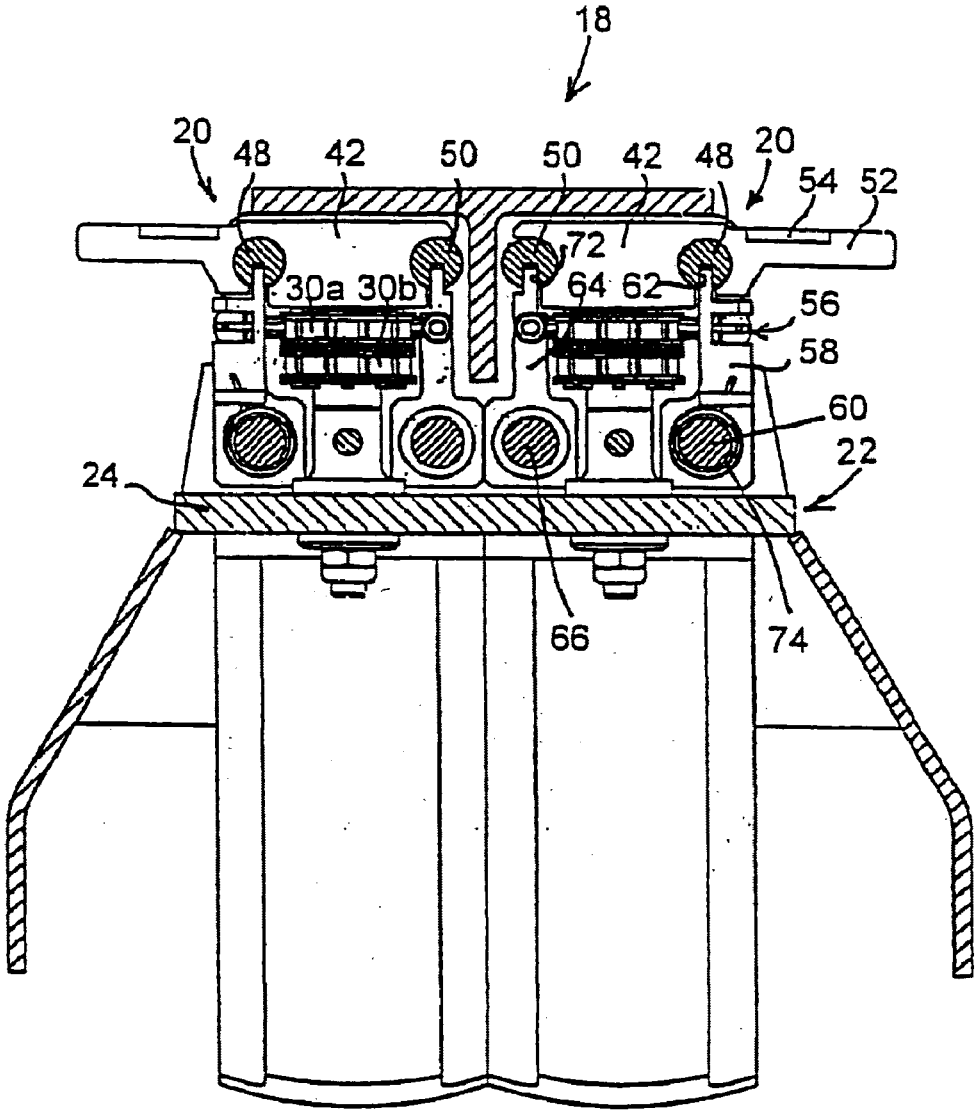
FIG. 4 is a cross-sectional view of the apparatus in FIG. 3, showing some additional components of the apparatus.
Figures 5, 6:
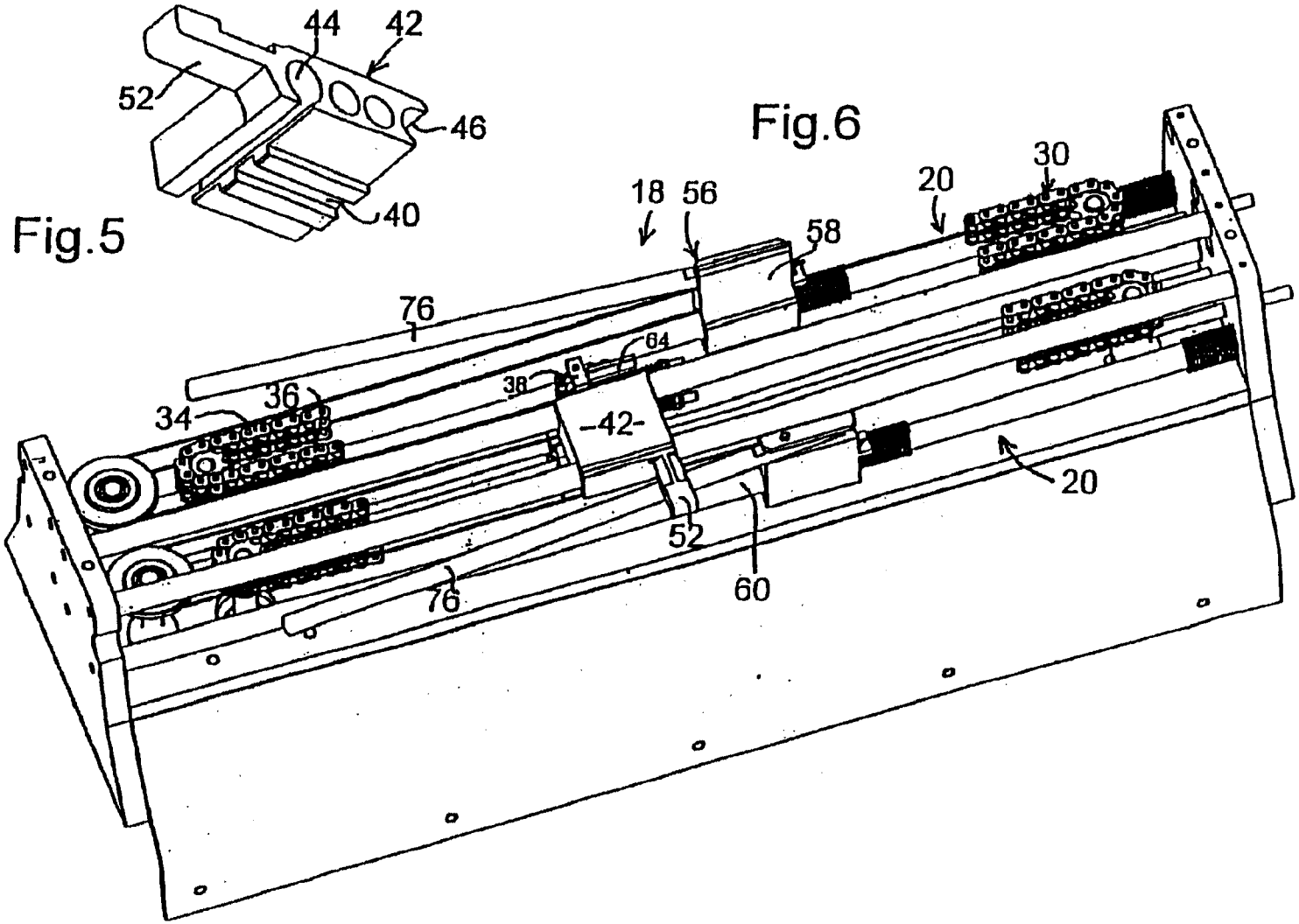
FIG. 5 is a perspective view from below of a first ramming element of the apparatus according to the invention.
FIG. 6 is a view similar to FIG. 3 but shows a phase of the linear return movement of the first ramming element, when a driver means on its underside engages with a slide of a second drive element which brings about a forward movement of a second ramming element simultaneously with the continued return movement of the first ramming element.
Figure 7:
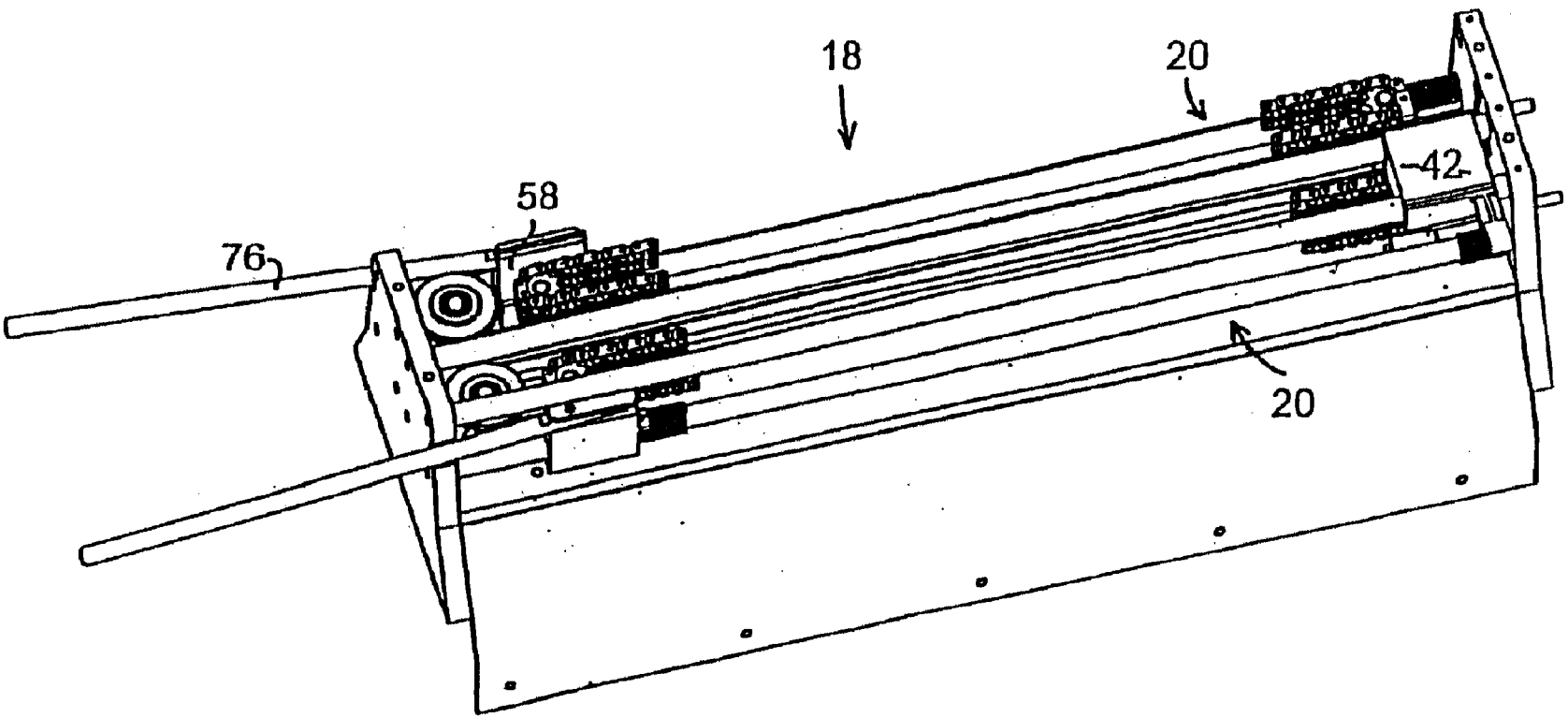
FIG. 7 is a view similar to FIGS. 3 and 6 but shows the second ramming element in its most advanced position.

As shown in FIGS. 3, 6 and 7, the second ramming element 56 has an elongate, rod-shaped pushing element 76 which can be pivoted out into a position of engagement with the rear portion of the shell G according to FIGS. 6 and 8*b*, when the driver element 38 on the underside of the first ramming element 42 comes up against the inner slide 64 during the return movement of the first ramming element 42, as shown in FIG. 6. In this connection, the continued return movement backwards of the first ramming element 42 is converted by means of the line 68 into a forward movement of the second ramming element 56, as a result of which a secondary feed of the shell G into a position corresponding to FIGS. 7 and 8*c* is brought about. FIG. 9 shows how the line 68 is fastened in a rear portion of the pushing element 76 and how the latter is pivotable about a vertical pivot pin 78 counter to the action of a compression spring 80. When the first ramming element 42 reaches its rear end position on the guides 48, 50, the driver element 38 is displaced outwards in the transverse direction in its groove 40 and comes out of engagement with the inner slide 64. At this moment, the stretched tension spring 74 rapidly returns the second ramming element 56 to its starting position according to FIG. 3, in which the compression spring 80 keeps the pushing element 76 folded in close to the long side of the discharging arrangement 18. The latter is then ready for discharging the next shell from the magazine 14 in a two-step procedure, in which the first ramming element 42 therefore first performs an initial, primary ejection and feed movement of the shell and the second ramming element 56 then comes into play during the return movement of the first ramming element 42 and performs a secondary advance movement of the shell to the loading mechanism 16.

Although the shells in the embodiment of the discharging arrangement 18 shown are fed forwards to a separate loading mechanism 16 located behind an associated weapon barrel 12, it is possible within the scope of the invention—by virtue of the long feed distance in relation to the length of the arrangement 18—to insert the shells directly into the rear end of the barrel and thus bring about rapid direct loading of the weapon.

What is claimed is:

1. Apparatus for discharging shells from an ammunition magazine, comprising:

a frame and a drive arrangement supported by the frame for individual linear displacement of shells from a first ejection position in the magazine to a second advanced position;

said drive arrangement comprising an endless, first drive element with two elongate, parallel strands including a first strand and a second strand;

a first ramming element connected to the first drive element and arranged so as to come into engagement with a rear portion of a shell present in the first ejection position and advance the shell to an intermediate position between said first ejection position and said second advanced position during the movement of the first ramming element together with the first drive element along the first strand; and a second ramming element arranged so as to come into engagement with the rear portion of the shell present in the intermediate position and advance the shell further to the second advanced position during a return movement of the first ramming element together with the first drive element along the second strand.

2. The apparatus according to claim 1, wherein the first ramming element can be displaced to and from on a first guide means in the frame, parallel to the first drive element.

3. The apparatus according to claim 2, wherein the first ramming element is connected to the first drive element via a driver mounted slidably in the first ramming element in a direction transverse to the displacement direction of the first ramming element on the first guide means and mounted rotatably on the first drive element.

4. The apparatus according to claim 3, wherein the driver is arranged so as to come into engagement with a second drive element, which is kinematically connected to the second ramming element, during the return movement of the driver together with the first ramming element along the second strand of the first drive element.

5. The apparatus according to claim 4, wherein the second drive element comprises a slide mounted displaceably on a second guide means parallel to the first guide means and is connected to the second ramming element via a flexible, force-transmitting element arranged so as to bring about a simultaneous displacement movement of the slide and the second ramming element in opposite directions.

6. The apparatus according to claim 5, wherein the second ramming element has a sliding member mounted displaceably on a third guide means parallel to the first and second guide means.

7. The apparatus according to claim 6, wherein the flexible, force-transmitting element comprises a line which extends between the slide and the sliding member via a front line guide wheel.

8. The apparatus according to claim 6, wherein the second ramming element is pretensioned towards a rear end position by a spring member.

9. The apparatus according to claim 8, wherein the spring member comprises a tension spring connected to the sliding member of the second ramming element and a rear part of the frame.

10. The apparatus according to claim 9, wherein the tension spring is threaded onto the third guide means.

11. The apparatus according to claim 6, wherein the slide and the sliding member which are displaceable on the second and third guide means are also guided by the first guide means.

12. The apparatus according to claim 11, wherein the first guide means comprises two horizontally separate, parallel first guides lying above and parallel to other guides constituting the second and third guide means.

13. The apparatus according to claim 12, wherein the slide and the sliding member on the other guides of the second and third guide means engage in respective grooves on the underside of the first guides lying above.

14. The apparatus according to claim 5, wherein the second ramming element has a forwardly directed rod which can be folded out into a position of engagement with the rear portion of the shell when a displacement movement backwards of the slide of the second drive element takes place on the second guide means.

15. The apparatus according to claim 14, wherein the rod is pretensioned towards a folded-in position in the frame.

16. The apparatus according to claim 1, wherein the first ramming element has a laterally projecting finger for engagement with a rear portion of a shell.

17. The apparatus according to claim 1, wherein the first drive element comprises an endless chain which runs via a gear drive and, respectively, a guide wheel at the ends of the first drive element.

18. A shell-discharging arrangement comprising two apparatuses according to claim 1 arranged side by side in a mirror-inverted manner in relation to one another, and wherein the frame of each apparatus is common.

19. The shell-discharging arrangement according to claim 18, wherein each of the ammunition magazine of each of said apparatuses are arranged adjacent and in parallel to one another, and the shell-discharging arrangement is positioned between the magazines.

* * * * *